US007927032B2

(12) United States Patent
Sanchez

(10) Patent No.: US 7,927,032 B2
(45) Date of Patent: Apr. 19, 2011

(54) DEVICE FOR DISPENSING A COSMETIC AND/OR CARE PRODUCT

(75) Inventor: Marcel Sanchez, Aulnay Sous Bois (FR)

(73) Assignee: L'Oreal, Paris (FR)

( * ) Notice: Subject to any disclaimer, the term of this patent is extended or adjusted under 35 U.S.C. 154(b) by 104 days.

(21) Appl. No.: 12/108,170

(22) Filed: Apr. 23, 2008

(65) Prior Publication Data

US 2008/0260450 A1 Oct. 23, 2008

Related U.S. Application Data

(60) Provisional application No. 60/916,324, filed on May 7, 2007.

(30) Foreign Application Priority Data

Apr. 23, 2007 (FR) ..... 07 54638

(51) Int. Cl.
*A46B 11/00* (2006.01)

(52) U.S. Cl. ..... 401/129; 401/126; 401/195; 401/52; 362/118; 362/136

(58) Field of Classification Search ..... 401/194, 401/118, 121, 122, 126–130, 195, 52; 362/118, 362/136
See application file for complete search history.

(56) References Cited

U.S. PATENT DOCUMENTS

| | | | | |
|---|---|---|---|---|
| 2,269,750 | A | 1/1942 | Baird | |
| 2,651,709 | A | 9/1953 | Ross et al. | |
| 4,888,667 | A | 12/1989 | Hwang | |
| 5,025,354 | A * | 6/1991 | Kondo | 362/135 |
| 6,527,402 | B1 | 3/2003 | Borri | |
| 6,697,199 | B2 | 2/2004 | Gerhard et al. | |
| 6,842,284 | B2 | 1/2005 | Gerhard et al. | |
| 6,866,403 | B1 | 3/2005 | Schaak | |
| 7,448,767 | B2 * | 11/2008 | Zhang | 401/195 |
| 2001/0032655 | A1 | 10/2001 | Gindi | |
| 2002/0172543 | A1 | 11/2002 | Nadel | |
| 2003/0172949 | A1 | 9/2003 | Alexander et al. | |
| 2005/0135088 | A1 | 6/2005 | Helenowski | |
| 2005/0286966 | A1 | 12/2005 | Gueret | |
| 2006/0146557 | A1 | 7/2006 | Levy et al. | |
| 2006/0171770 | A1 * | 8/2006 | Bitton | 401/195 |
| 2007/0017542 | A1 | 1/2007 | Petit | |
| 2007/0186948 | A1 | 8/2007 | Kim et al. | |

FOREIGN PATENT DOCUMENTS

| | | |
|---|---|---|
| EP | 0 435 420 | 7/1991 |
| GB | 390 420 | 4/1933 |
| GB | 390 802 | 4/1933 |
| WO | WO 99/22782 | 5/1999 |
| WO | WO 00/40112 | 7/2000 |
| WO | WO 03/009062 | 1/2003 |

* cited by examiner

*Primary Examiner* — David J. Walczak
*Assistant Examiner* — Keegan Gumbs
(74) *Attorney, Agent, or Firm* — Oblon, Spivak, McClelland, Maier & Neustadt, L.L.P.

(57) ABSTRACT

A device for dispensing a cosmetic and/or care product includes a container having a free edge defining a product dispensing aperture. According to an example, the container has a longitudinal axis intersecting the dispensing aperture, a cap to be mounted on the container between closed and open positions, a sensory stimulation member or device fixed in relation to the container or the cap housing it. A power supply switch is inaccessible in the closed position, and capable of making the sensory stimulation member change state. A switch actuator selectively connects the power supply to the sensory stimulation member during movement of the cap from the closed position to the open position.

17 Claims, 8 Drawing Sheets

DEVICE FOR DISPENSING A COSMETIC AND/OR CARE PRODUCT

CROSS-REFERENCE TO RELATED APPLICATIONS

This document claims priority to French Patent Application No. 07 54638, filed on Apr. 23, 2007 and U.S. Provisional Application No. 60/916,324, filed on May 7, 2007, the entire contents of both of which are hereby incorporated by reference.

FIELD OF THE INVENTION

The invention relates to a device for dispensing a cosmetic and/or care product. A preferred, but not exclusive, field of the present invention relates to using a sensory stimulation member, such as a lamp, a vibrator, an audible alarm or some other, so as to either detect incorrect closing of the container, a cause of drying up and oxidation of the cosmetic and/or care product, or facilitate the removal and/or application of this product onto a given body surface. "Cosmetic product" means a product as defined in Council Directive 93/35/EEC of 14 Jun. 1993.

BACKGROUND OF THE INVENTION

Discussion of Background

GB 390 420, EP 0 435 420, U.S. Pat. No. 2,269,750, U.S. Pat. No. 2,651,709, U.S. Pat. No. 4,888,667, U.S. Pat. No. 6,866,403, US Publication 2002/0172543, US Publication 2005/0135088, US Publication 2005/0286966, US Publication 2006/0146557, US Publication 2007/0186948 and WO 03/09062 disclose examples of devices of the prior art.

EP 0 435 420 discloses a device in the form of a make-up case. This case includes a container on which a cap is mounted and able to pivot. The cap houses a lamp. Furthermore, the cap houses batteries and a switch intended to selectively electrically connect the power supply to the lamp.

The container includes a recess in which the make-up product is accommodated. A radial surface extends from the recess, and the radial surface forms an actuation surface for the switch. More precisely, the radial surface makes it possible to act on the switch when the cap is moved from its open position to its closed position. The switch then makes the lamp change from an activated state to an inactivated state.

However, one drawback associated with this device is that the cooperation of the switch with the radial surface can lead to incorrect closing of the cap, and cause problems in sealing of the case. Such a sealing problem can lead to physicochemical changes in the product. Such changes can lead to drying of the product, which can harden or to oxidize the product, and possibly change in color of the product or more generally to a change in the properties of the product.

Another drawback associated with this device is due to the actual physical nature of the switch. This is because, after several movements of the cap between its open and closed positions, it can lose its elasticity and thus lead to a poor electrical supply or reliability for the lamp.

SUMMARY OF THE INVENTION

One aim of the present invention is therefore to provide a device that overcomes at least one of the above-mentioned drawbacks.

Another aim of the present invention is to provide a device that ensures both good sealing of the device and a good connection between the electrical components.

One aim of the present invention is also to provide a device that ensures a selective contact between a sensory stimulation member or device, such as a lamp, and a power supply, which is not impaired with usage of the device or at least has improved reliability.

According to a preferred example, a device for dispensing a cosmetic and/or care product is provided that includes a container to contain the product and a free edge defining a product dispensing aperture. The container has an elongation axis or longitudinal axis intersecting the dispensing aperture, a cap, optionally removable, and which can be mounted on the container between a closed position which closes the aperture and an open position in which the aperture is open or allows access thereto. A sensory stimulation member is mounted or fixed in relation to the container or the cap housing it, and a power supply powers the sensory stimulation member. A switch makes the sensory stimulation member change state, and a switch actuator or actuation means selectively connects the power supply to the sensory stimulation member during the movement of the cap from its closed position to (or toward) its open position. In addition, in the closed position of the cap, the free edge and the actuation means extend according to two distinct respective axial heights and in which the actuation means are axially offset in relation to the dispensing aperture.

By way of example, the container can have an elongation axis orthogonal to the dispensing aperture.

Also by way of example, the sensory stimulation member can be fixed either to the cap, or to the container. This definition also includes the case where the sensory stimulation member or device is fixed to a component, or a holder, which is added onto, or into, the cap or the container.

Unless otherwise specified, "sensory stimulation member fixed in relation to the container or the cap housing it" or similar expressions should be understood to mean that the sensory stimulation member is incapable of being driven rotationally, for example pivotally, or translationally in relation to the structure to which it is fixed. Thus, during removal of the cap in relation to the container and/or during its repositioning, the sensory stimulation member remains stationary in relation to the structure accommodating it.

The movement of the cap from its closed position to its open position can automatically connect the power supply to the sensory stimulation member or device. The switch actuator or actuation means can thus be capable of automatically selectively connecting the power supply to the sensory stimulation member during movement of the cap from its closed position to its open position. The sensory stimulation member or device can thus change from an inactive state to an active state instantaneously (or at least soon) during removal of the cap. The removal of the cap as such can thus make it possible to change from this inactive state to this active state. In other words, the sensory stimulation member or device can thus change from an inactive state to an active state solely by removing the cap. Conversely, the sensory stimulation member or device can change from an active state to an inactive state during the replacing of the cap on the container. The switch can be inaccessible, and thus unable to be actuated, in the mounted position of the cap on the container. The change from an inactive state to an active state, and vice versa, of the sensory stimulation member can therefore take place without direct finger action exerted on the switch.

According to an example of an embodiment, the switch can include a free edge defining a support surface coming into contact with an actuation surface of the actuation means in the closed position. The support surfaces and actuation surfaces extend to a distinct respective axial height in relation to the free edge defining the dispensing aperture and are axially offset in relation to the dispensing aperture.

The device can include a seal arrangement or means of sealing the dispensing aperture fixed to the cap. For example, the device can include a seal or means of sealing configured to cooperate with the dispensing aperture. The sealing means can be configured to come to rest in a sealed manner on the free edge of the container. In a variant or additionally, the sealing means can include a skirt mounted clamped in a sealed manner against an internal face of the dispensing aperture. In a variant or additionally, the seal or sealing means can include a lip or a seal capable of coming to rest on the free edge of the container.

According to an example, the switch can preferably be inaccessible in the closed position of the cap.

Also by way of example, the actuator or actuation means and the free edge can extend according to two distinct planes parallel to each other. For example, actuation means and the free edge can extend according to two distinct planes substantially perpendicular to the elongation or longitudinal axis of the container.

According to a disclosed example, the container can include a neck. By "neck" it should be understood that the container includes a dispensing tube with a cross-section that is narrow in relation to a cross-section of the body of the container and projecting in relation to this body. In other words, this neck can include a shoulder from which a mouth or mouthpiece provided with a free edge rises. The switch and/or the actuation means can extend at the level of this shoulder. By way of example, the ratio of the height of this neck, and more precisely the height of the opening or mouth, in relation to the total height of the container, that is the height measured between the free edge delimiting the dispensing opening to the bottom of the container intended to come into contact with a resting surface, can lie between 0.1 and 0.4 and more preferably between 0.12 and 0.26. For example, the height of the mouth can lie between 10 mm and 20 mm and more preferably between 12 mm and 17 mm.

The mouth or mouthpiece can include reversible fixing means, for example a thread, for mounting the cap.

According to an example of an embodiment, the switch can extend through a wall of the container. The cap can include a free end capable of cooperating with the switch. The switch can also extend through the cap.

Also by way of example, the device can include a holder mounted in a fixed manner in the cap, for example with the holder including a passage through which the switch extends. This holder can include a free rim capable of coming opposite a shoulder of the container, with the switch for example projecting in relation to this rim. The holder can include a housing capable of accommodating the sensory stimulation member device.

According to an example, the switch can include at least one leg slidably movable in relation to the cap and/or the container. This switch can include two legs extending on either side of the dispensing aperture.

By way of example, the actuation means or actuator can be adapted to move the switch, together with the power supply, during the movement of the cap between its open and closed positions. The switch can be acted on by elastic means, for example. The elastic means can be in a compressed state in an inactive state of the sensory stimulation member and in a relaxed state in an active state of the sensory stimulation member. Also by way of example, the sensory stimulation member can include illumination means, for example, at least one light emitting diode. Such illumination means can include two light emitting diodes extending on either side of the dispensing aperture.

Further by way of example, the container can be made from a light-transmitting material, with the sensory stimulation member disposed, for example, under a bottom wall of the container opposite to the dispensing aperture.

The device can moreover also include product applicator, for example fixed to the cap. The applicator or application means can be configured for applying a make-up product such as lip gloss, lipstick, nail varnish, mascara or eye liner. The applicator can include, for example, a rod provided with an application element chosen from amongst a brush of the bottle brush type, a brush of the paintbrush type, a flocked member and a lipstick.

By way of example, the dispensing aperture can provide access to the product directly, with the container then lacking a dispensing means of the pump or valve type.

The present invention also provides, according to another aspect or example of an embodiment, a device for dispensing a cosmetic and/or care product including a container to contain the product and including a neck having a shoulder from which protrudes a mouth or mouthpiece fitted with a free edge defining a product dispensing aperture. The container can have an elongation axis or longitudinal axis intersecting the dispensing aperture, a cap intended to be mounted on the container between a closed position and an open position allowing access to the aperture, a sensory stimulation member or device, a power supply for the sensory stimulation member, and a switch capable of changing the state of the sensory stimulation member. A switch actuator or actuation means is capable of selectively connecting the power supply to the sensory stimulation member during the movement of the cap from the closed position to the open position, in which the switch actuation means are formed by the shoulder.

In the closed position of the cap, the free edge and the shoulder extend according to two distinct respective axial heights. This shoulder is axially offset in relation to the dispensing aperture.

As should be apparent, the invention can provide a number of advantageous features and benefits. It is to be understood that, in practicing the invention, an embodiment can be constructed to include one or more features or benefits of embodiments disclosed herein, but not others. Accordingly, it is to be understood that the preferred embodiments discussed herein are provided as examples and are not to be construed as limiting, particularly since embodiments can be formed to practice the invention that do not include each of the features of the disclosed examples.

BRIEF DESCRIPTION OF THE DRAWINGS

A better understanding of the invention will be gained from reading the following description in conjunction with the accompanying figures. The figures are offered purely as a guide and by way of example, and in no way limit the invention.

DETAILED DESCRIPTION OF THE PREFERRED EMBODIMENTS

A better understanding of the invention will be gained from reading the following description in conjunction with the accompanying figures. The figures are offered purely as a guide and by way of example, and in no way limit the invention.

Figure 1:
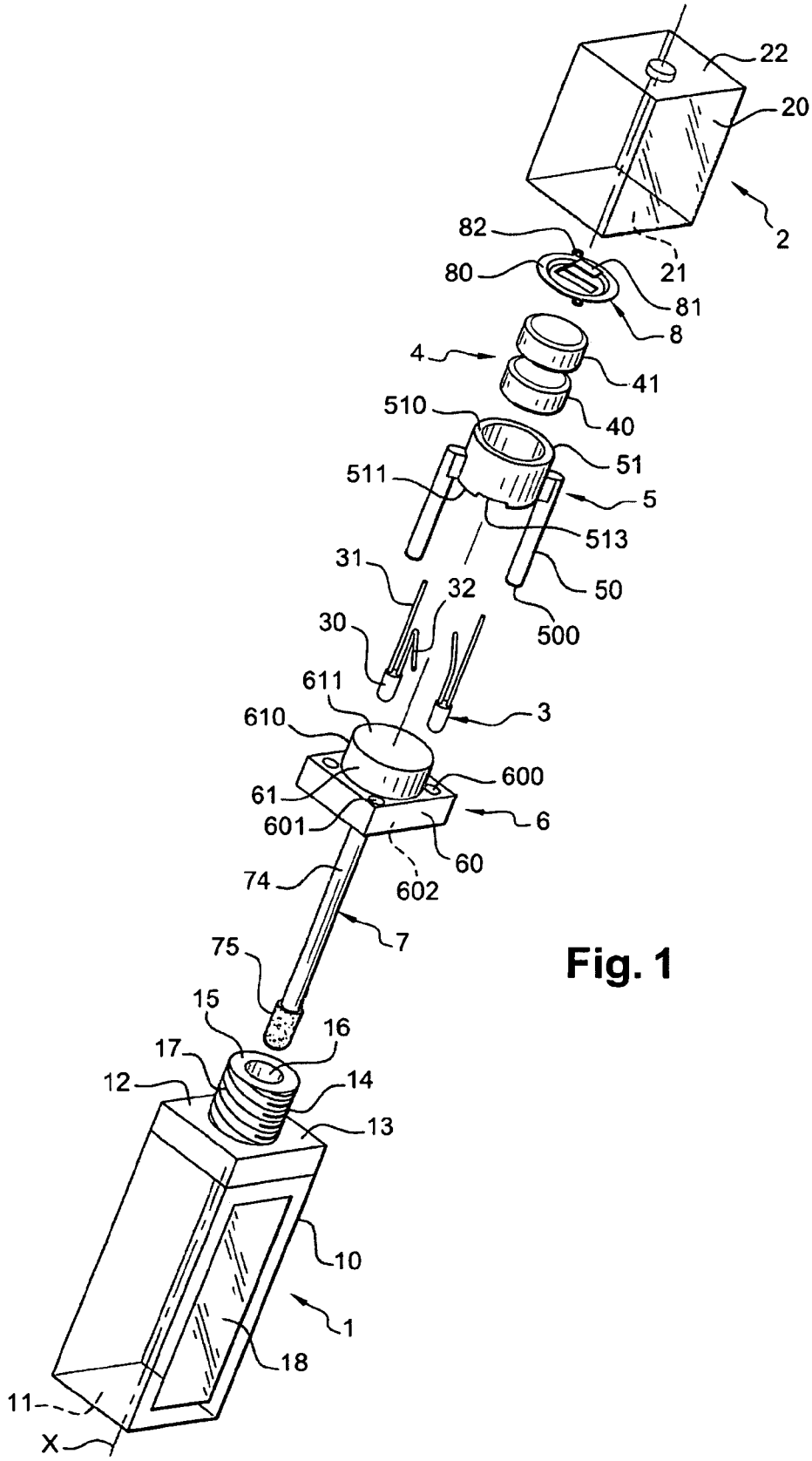
FIG. 1 is a schematic exploded perspective view of one example of an embodiment of the device according to the invention.
Figure 2:
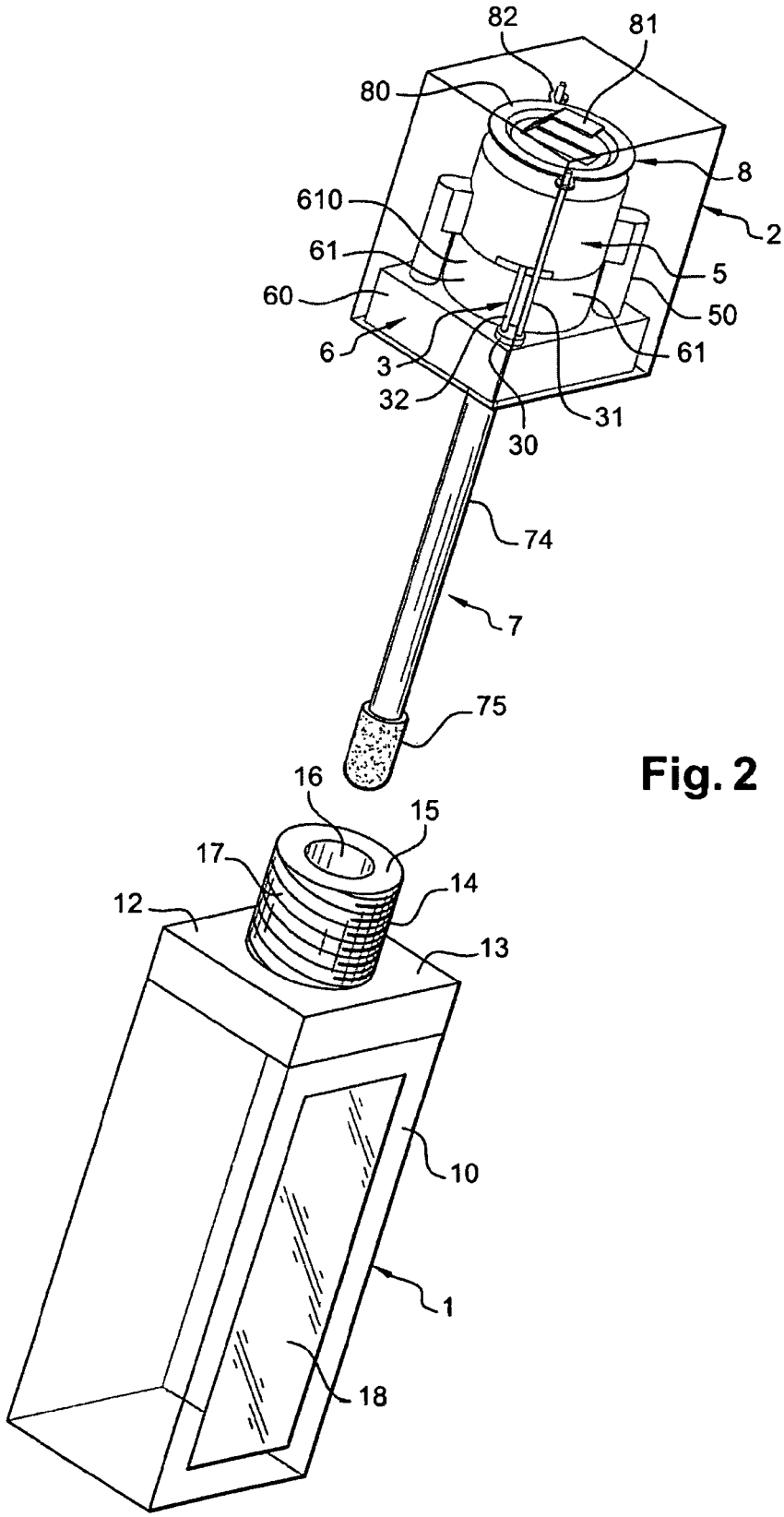
FIG. 2 is a schematic partly assembled perspective view of the device depicted in FIG. 1.

FIGS. 1 and 2 depict an example of one embodiment of a device according to the present invention including on the one hand a container 1, a cap 2, a sensory stimulation member or device 3, a power supply 4, a switch 5 and an actuator or means of actuating this switch.

The container 1 can be a small bottle, for example with a capacity of 2 to 100 ml. Such a container 1 can for example have a width lying between 10 and 20 mm, and preferably between 14 and 18 mm, and a height H2 lying between 50 and 100 mm, and preferably between 65 and 75 mm in this example. This container can contain a cosmetic and/or care product such as lip gloss, lipstick, nail varnish, mascara or eye liner. The product contained inside can be in solid or paste form, but is preferably in liquid form and, in particular, in fluid or viscous form.

In the illustrated example, the container includes a side wall 10 connecting a bottom wall 11 to a neck 12. In this example embodiment, the side wall 10 has a square-shaped cross-section. However, it could have any other suitable shape such as circular, elliptical, oval or polygonal. This side wall 10 can furthermore include a face provided with a mirror 18 intended to assist the user in applying the product removed.

The neck 12 can include a shoulder 13 from which a mouth or mouthpiece 14 rises.

The mouthpiece 14 can extend to a height H1. This height can for example lie between 10 mm and 20 mm and especially between 12 mm and 17 mm. It can include a free edge 15 defining a dispensing aperture 16. Such a container includes a main elongation axis or longitudinal X intersecting the dispensing aperture. The shoulder 13 is therefore offset axially in relation to the dispensing aperture 16 and the free edge 15 that defines it. The shoulder 13 and the free edge 15 furthermore extend a distinct respective height from the container 1. The free edge 15 can be separated from the bottom wall 11 by a spacing greater than the spacing separating the shoulder 13 from the bottom wall 11.

The shoulder 13 and the free edge 15 can therefore extend according to a distinct respective plane Y, Z. These planes Y and Z can be parallel to each other. In a variant, these planes could intersect. The planes Y and Z can be perpendicular to the longitudinal or elongation axis X. This shoulder 13 and this free edge 15 can be spaced apart from each other by a height lying between 5 and 15 mm, and in particular between 8 and 12 mm, for example.

In this example embodiment, the dispensing aperture 16 is circular in shape. However, this aperture could have any other suitable shape such as square, elliptical, oval or rectangular. With this example, it should be noted that this dispensing aperture preferably lacks any dispensing system of the pump or valve type. The cosmetic and/or care product contained inside can thus flow out by gravity through the dispensing aperture, simply by tilting the container. Such a dispensing aperture of the container can then be closed in a sealed manner by the cap 2 or a part fixed to the cap.

The mouth or mouthpiece 14 can be provided with fixing means 17 intended for mounting the cap 2. In this example, the mouthpiece comprises a thread. Such a thread can be provided on an external face of the mouthpiece. In a variant, the fixing means could include a latching means or a surface adapted for mounting the cap with a tight fit. Alternate suitable fixing or attaching expedients could alternately be used. Such fixing means can thus extend between the free edge 15 and the shoulder 13 of the container 1.

It should be noted that the neck 12 can be added onto the side wall 10 of the container. Such a neck can then advantageously be made from an opaque material. This material can for example be a plastic or metallic material. As for the container, this can advantageously be made from a transparent material such as a plastic material or glass.

The cap 2 is removable from the container 1. The illustrated example includes a body 20 having an open end 21 and an end closed by a bottom 22. The body can have a square-shaped cross-section. Such a body can thus be positioned in line with the side wall 10 of the container in the position closing the dispensing aperture. Other cross-sectional shapes can of course be envisaged for this cap.

The device according to the example of the present invention can include a holder 6. This holder can for example be made from a transparent or opaque plastic material. Such a holder has in this example an overall parallelepipedal shape of square cross-section. In a variant, such a holder could be cylindrical and have a cross-section of circular, elliptical, oval, polygonal or some other shape. This holder can include a plate 60 having at least one through passage 600. This plate can also include at least one positioning aperture 601. In the example embodiment depicted, the plate 60 includes two through passages 600 and two positioning apertures 601. Such apertures can be blind (partially through) or extend entirely through the plate.

The through passages can extend according to a plane T and the positioning apertures can extend according to a plane P. These planes T and P can intersect. Their intersection axis can extend at the level of the dispensing aperture 16. This intersection axis can be parallel to the main elongation axis X of the container and in particular coincident with this axis in the illustrated example. The function of these passages and these apertures will be explained further in the remainder of this description.

The plate 60 can also include a free rim 602 capable of coming opposite the shoulder 13 of the container. More precisely, this free rim can be capable of coming to rest on the shoulder 13.

The holder 6 can furthermore include a platform 61 rising from the plate 60. This platform can include a skirt 610 connecting the plate 60 to a surface 611. In the example embodiment depicted, this plate 60 and this platform 61 are made in a single piece. Nevertheless, this plate and this platform could be made in two separate pieces. In such a case, these two pieces could be fixed to each other by any suitable means.

The skirt 610 can have a cylindrical configuration with a circular or some other cross-section. Such a skirt can include an internal face intended for mounting product application means 7. Such product application means can then be fixed by any suitable means, such as by screwing, latching, fitting or some other arrangement or expedient.

The product applicator or application means 7 can include a socket 70 clamped in the skirt 610. This socket can be connected to an internal skirt 72 by a radial collar 71. The internal skirt 72 and the socket 70 can be concentric. By way of example, the internal skirt 72 can be connected to a rod 74 by a tapered portion 73.

Figure 11:
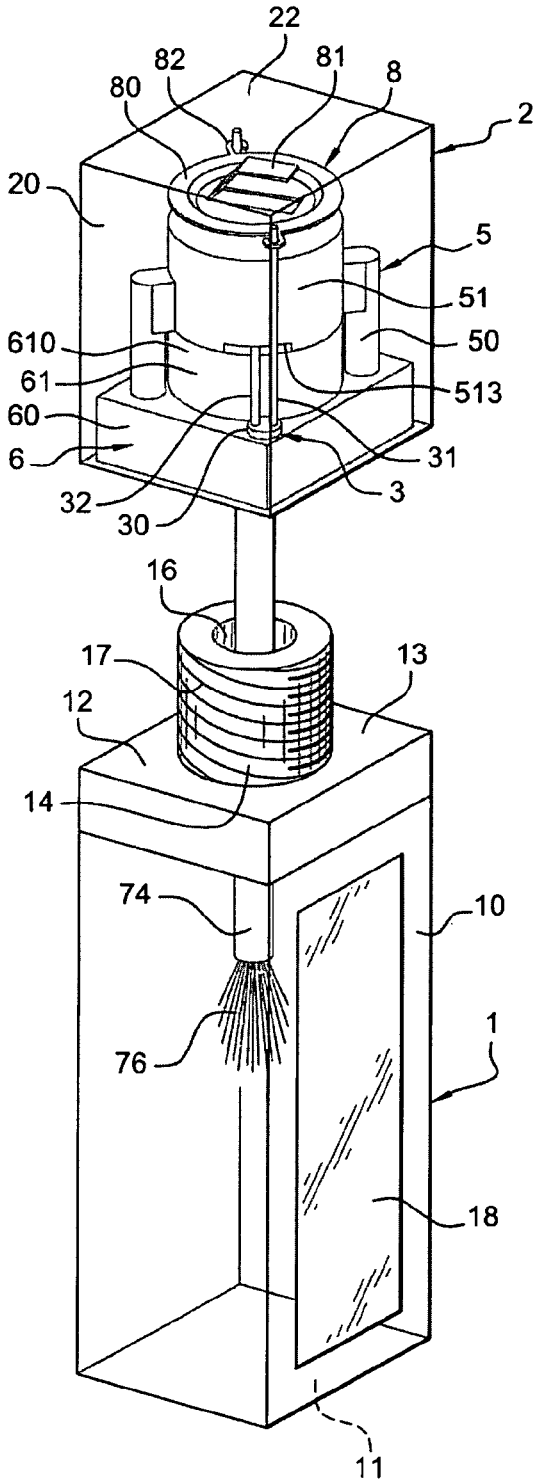
FIG. 11 is a schematic perspective view of a variant embodiment of the device according to the invention.
Figure 12:
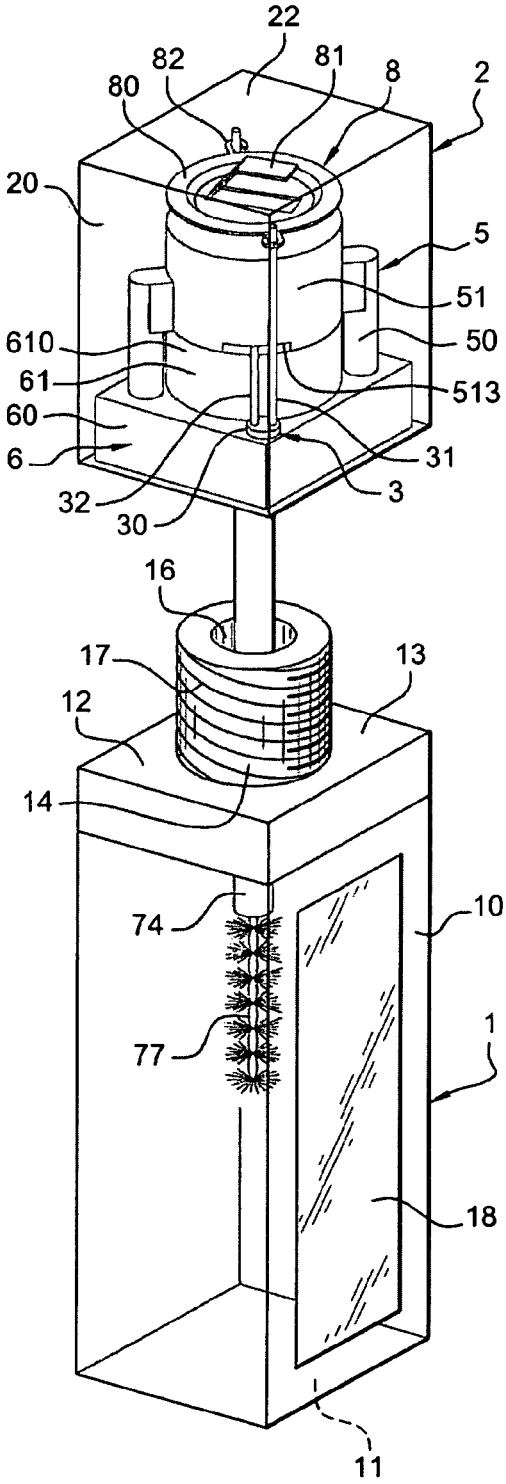
FIG. 12 is a schematic perspective view of a variant embodiment of the device according to the invention.

The rod 74 can support a product application element. In FIGS. 1 and 2, this element includes a flocked tip 75. In FIG. 11, this element includes a brush of the paintbrush type 76 provided with a bunch of hairs. In FIG. 12, this element includes a brush of the bottle brush type or comb 77. Such a brush can includes a core supporting a plurality of hairs projecting radially towards the outside or radially outwardly. Other application elements could be used. The socket 70 can be covered internally with fixing means adapted to cooperate with the fixing means 17 of the mouthpiece 14. Such a fixing or connecting arrangement or fixing means include in this example a thread. Other means of fixing onto this mouthpiece can of course be used such as a mounting with a tight fit, latching or other suitable expedients.

The product application means or applicator 7 can serve as a member for closing off the dispensing aperture 16.

In a variant, a conventional stopper, lacking a rod for supporting a product application element, could be used.

Such closing-off members can be mounted on the mouth or mouthpiece 14 of the container 1 prior to mounting the holder 6.

According to another variant embodiment or example, the holder 6, and in particular the platform 61, can serve as a member for closing off the dispensing aperture 16. In such a case, the skirt 610 could itself support fixing means for its coupling onto the mouthpiece 14. As for the surface 611, this could come directly opposite the dispensing aperture and in particular to rest on the free edge 15 of the container.

Furthermore, the product application means 7 can be made as a single piece with the holder 6. In this case, the product application means could extend from the platform 61 and in particular from the skirt 610 and/or the surface 611 of this platform.

In this example embodiment, the sensory stimulation member 3 includes a visual means or visual indicator 30. This visual means can include an illumination device. Such a device can include at least one lamp and in a preferred example at least one light emitting diode. In this example, this visual means 30 includes two light emitting diodes each having a cathode 31 and an anode 32. Each visual means 30 can be accommodated at least partly in the positioning aperture 601 of the holder. These visual means are held in a fixed manner in these apertures. In other words, such sensory stimulation members, and if applicable such visual means, are incapable of being moved rotationally or translationally in relation to the structure housing it, in this case in relation to the cap, and in particular in relation to the holder. Such visual means can come to lie flush with the free rim 602 of the holder. These visual means can open out directly to the outside or a transparent material can be interposed between them and the outside.

The cathode 31 can extend in a straight manner from the visual means 30. The anode 32 can have a bent shape. The cathodes of the visual means 30 can be oriented towards each other. These anodes can both come to rest on the surface 611 of the platform 61 of the holder.

In an alternate example, the illumination device can include at least one incandescent, neon fluorescent, halogen, or sodium discharge lamp.

Such an illumination device can emit at a wavelength corresponding to the visible spectrum, for example between 405 and 700 nm. It can also emit at wavelengths less than or equal to 405 nm or greater than or equal to 700 nm. For example, it can emit in the UV spectrum, and in particular at wavelengths lying between 10 and 405 nm, and in particular between 280 and 405 nm. It can in particular emit at wavelengths lying between 365 and 405 nm, namely radiation consisting mainly of violet and near ultraviolet, of UVA type, thus corresponding to "black light".

In a variant or additionally, the sensory stimulation member 3 can include a device outputting a sensory (to the touch), audible and/or olfactory means (not depicted).

By way of further example, the sensory means can include vibration means. Such vibration means can for example include a motor with an eccentric weight. In this case, the eccentric weight can be mounted so as to rotate around a shaft and have a center of gravity offset with respect to this shaft.

More generally, a vibration device or vibration means can include any electromechanical, mechanical or electronic system capable of producing vibrations. Such an electromechanical system can for example include a piezoelectric element.

The audible device or audible means can include a device capable of emitting any noise, sound or music whatsoever. For example, this device can include a buzzer.

Finally, the olfactory device or olfactory means can include a device capable of dispensing a product distinct from that contained in the container or of changing smell on contact with light.

The power supply 4 can electrically power the sensory stimulation member 3. This power supply 4 can include, for example, two batteries 40, 41, for example mounted in series. These batteries can be button batteries for example of 1.5 or 3 V such as LR60 or LR620 lithium batteries, CR 2016 batteries or SR silver oxide batteries.

For example, the battery 40 can establish an electrical connection to the anode 32 of the visual (or other stimulation) means and the battery 41 can establish an electrical connection to the cathode 31 of the visual means.

In a variant, the power supply 4 can include only a single battery or a number of batteries greater than two. It should also be noted that all types of energy storage devices or energy sources could be used. For example, a photosensitive (or photovoltaic) cell could be used as a power supply.

The switch 5 can provide a selective power supply for the sensory stimulation member 3. Such a switch thus acts as an on/off switch capable of interrupting the electrical connection between the power supply and the sensory stimulation member 3. Operating such a switch 5 thus makes it possible to make the sensory stimulation member 3 change state. In particular, the sensory stimulation member 3 can change from an active state to an inactive state.

In this example, the switch 5 is in the form of a jumper link including two legs or posts 50 connected to a cross-member 51.

The legs 50 are configured to be mounted in the through passages 600 of the plate 60 of the holder. Such legs can be movably mounted by sliding in the through passages 600. The legs can include a free end 500. This free end can project in relation to the free rim 602 of the holder.

The cross-member 51 can include a sleeve having two opposite open ends respectively 510, 511.

The end 510 can define a mounting end for the power supply 4. This end 510 can also support an electrically conductive element 8 which will be discussed later.

The end 511 can include a flange 512 projecting radially towards the inside. This end 511 can thus include an opening smaller in size than the size of the opening defined by the end 510. The end 511 and the flange 512 can be provided with a bore or groove 513. The function of such a bore will be mentioned in the remainder of the description.

The end 511 defines a holding end for the power supply 4. The anodes 32 of the visual means 30 can be accommodated in the bore 513. Such a bore defines a housing for the anodes 32 of the visual (or other stimulation) means. Such a housing then extends under the power supply 4 and more precisely between the surface 611 of the platform of the holder and the cross-member 51 of the switch.

However, it is to be understood that the switch 5 could have any other suitable configuration.

The device according to the invention can also include an electrically conductive element 8 capable of establishing an electrical connection between the sensory stimulation member 3 and the power supply 4. In the illustrated example, this element 8 can establish an electrical link between the cathode 31 of the visual means and the battery 41. Such an element 8 can for example be made from a metallic material.

The element 8 can be in the form of a ring 80. Such a ring can be provided with two loops 82, for example. These loops can project towards the outside. They can extend in a radially opposite manner with respect to each other. Such loops 82 can respectively accommodate the cathode 31 of the visual means 30. These loops then allow the element 8 to slide in relation to the cathodes.

The device according to the invention can also include an elastic member or elastic means 81. In the example embodiment depicted, the ring 80 supports the elastic means.

As depicted in FIG. 1 in particular, the elastic means 81 can be made as a single piece with the conductive element 8.

Figure 9:
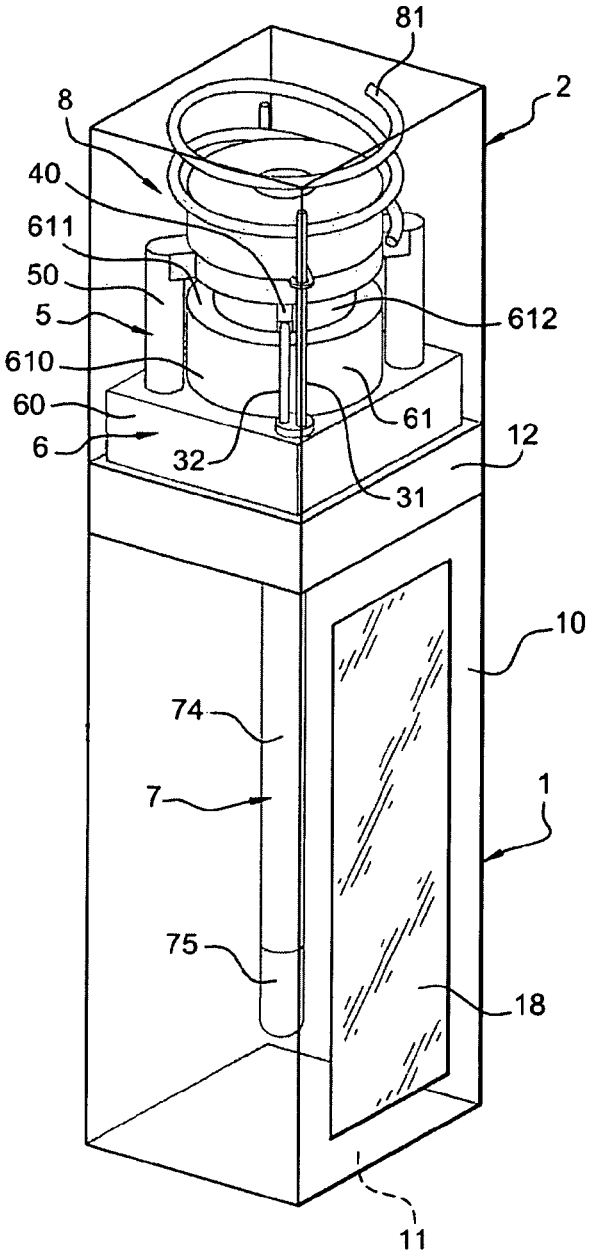
FIG. 9 is a schematic perspective view of a variant embodiment of the device according to the invention.

In a variant and as depicted in FIG. 9, the elastic means or member can be added onto the conductive element 8. This figure also shows that the elastic means 81 can be in the form of a coil spring. Such a coil spring can then be mounted clamped around the ring 80. Other embodiments or expedients can be used to provide an elastic (or spring) bias.

It should be noted that the elastic means could be connected in a fixed manner to the bottom 22 of the cap 2.

The holder 6, the visual means 30, the switch 5, the power supply and the electrically conductive element 8 together define an illumination module.

Such a module can be housed in the cap 2. To do this, this module can be mounted through the open end 21 of the cap. In the mounted position, the plate 60 of the holder can come to fit tightly against an internal face of the cap 2 so as to hold the module in a fixed manner in the cap 2. As for the elastic means or elastic device, this can come to rest against the bottom 22 of the cap.

The device according to the present invention also includes an actuator or means of actuating the switch 5. Such actuation means are adapted to act on the switch in order to make the sensory stimulation member change state. In the example depicted, the actuator or actuation means make the sensory stimulation member change from an active state to an inactive state. The actuation means will be described in the remainder of the description.

In the particular example embodiment depicted, this change of state corresponds to the selective illumination of the visual means 30. In the case of sensory (or tactile) means, it can correspond to the selective triggering of vibrations. In the case of an audible means, it can correspond to the selective triggering of any noise whatsoever. In the case of olfactory means, it can correspond to the selective dispensing of a scented product other than that contained in the container 1.

Figure 3:
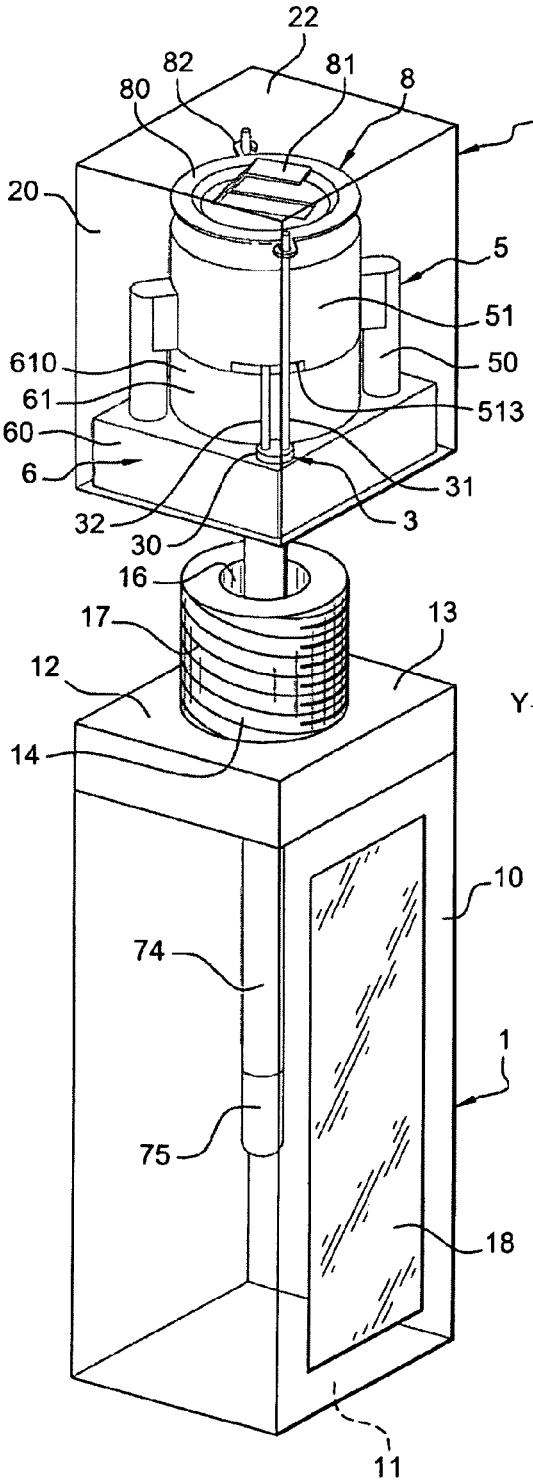
FIG. 3 is a schematic perspective view of the device depicted in FIG. 2 in a first position.
Figure 4:
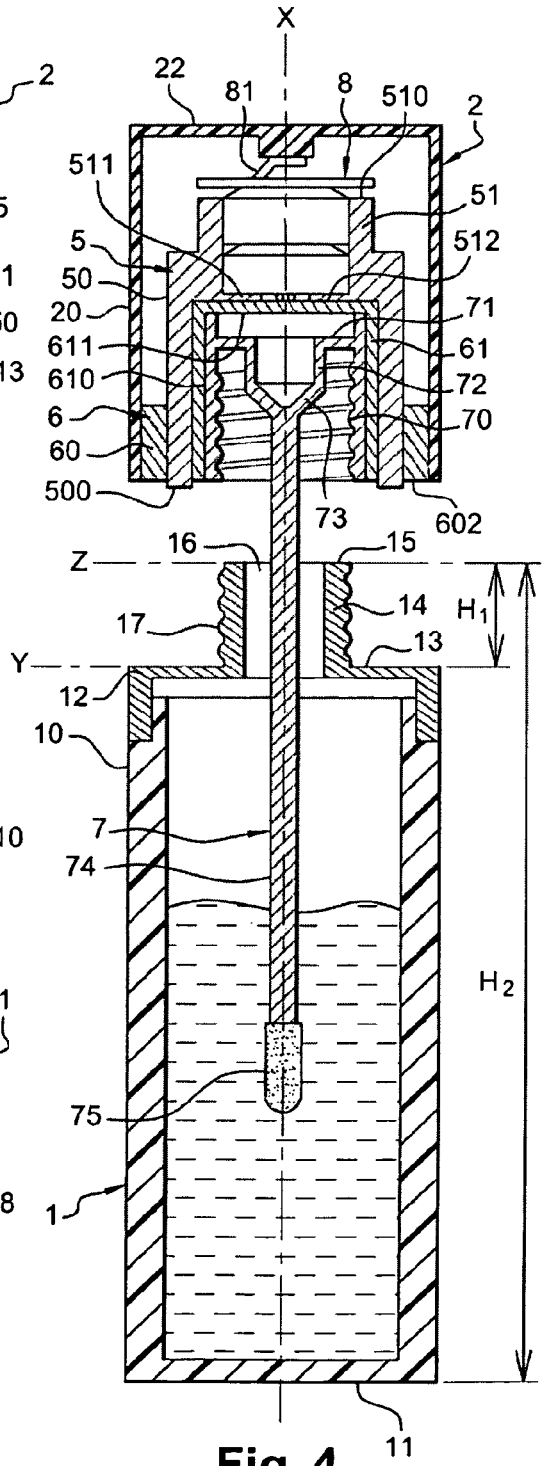
FIG. 4 is a schematic view in longitudinal section of the device depicted in FIG. 3.
Figure 5:
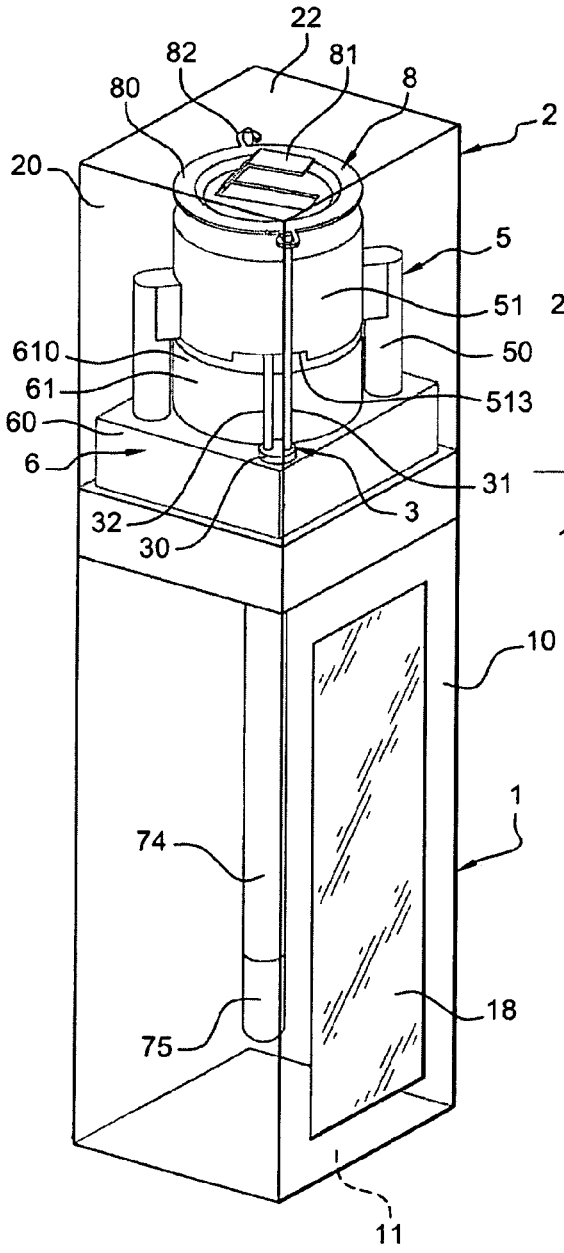
FIG. 5 is a schematic perspective view of the device depicted in FIG. 2 in a second position.
Figure 6:
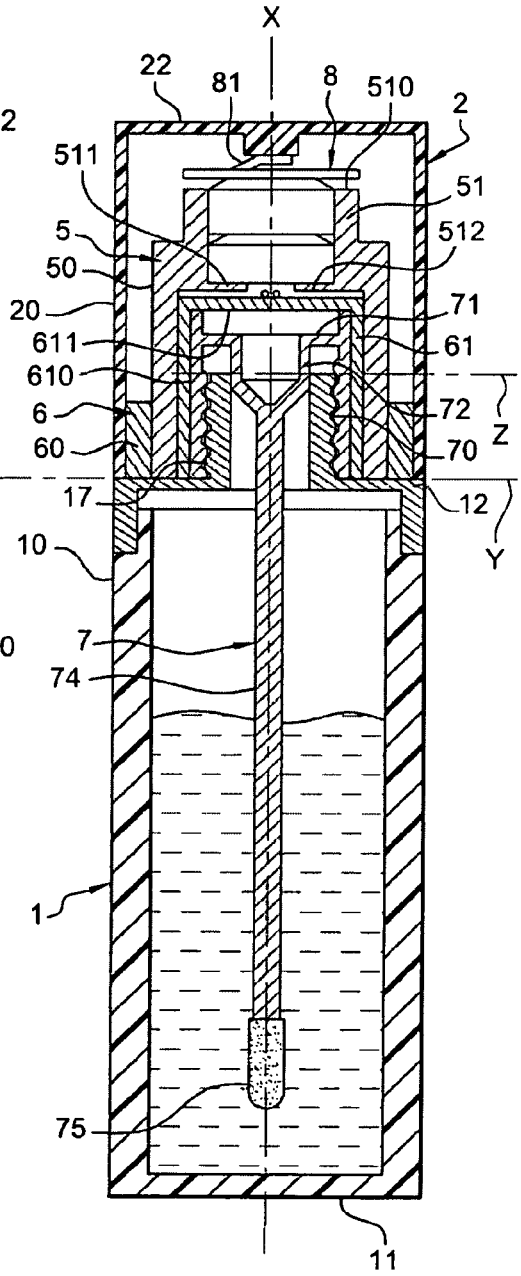
FIG. 6 is a schematic view in longitudinal section of the device depicted in FIG. 5.
Figure 7:
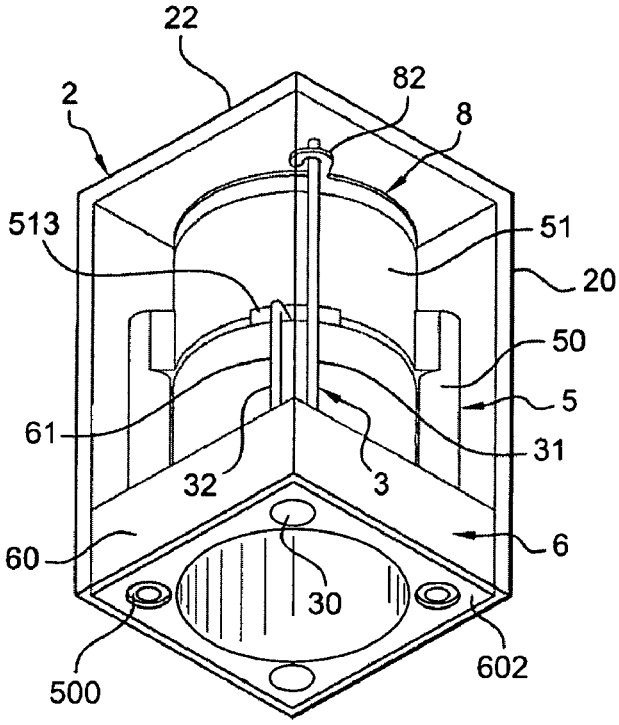
FIG. 7 is a schematic perspective view from underneath of part of the device according to the invention when the device is in the second position.
Figure 8:
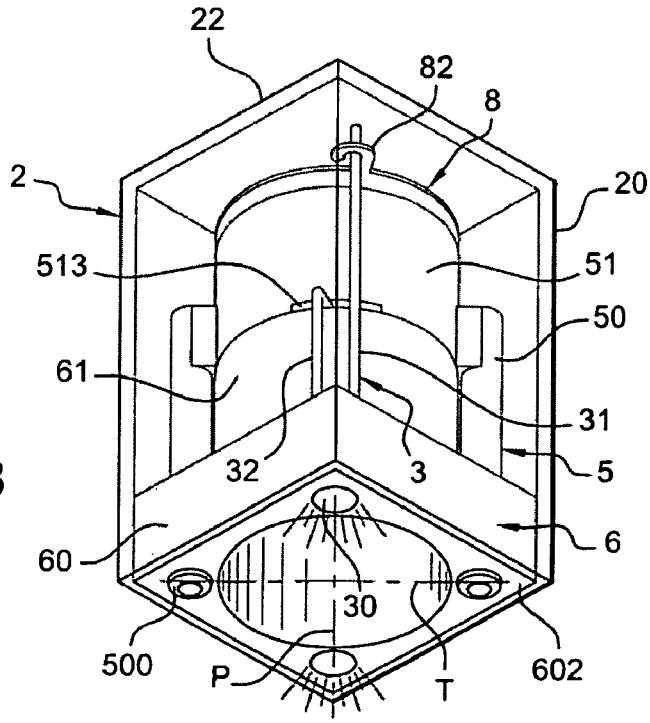
FIG. 8 is a schematic perspective view from underneath of part of the device according to the invention when the device is in the first position.

The cap 2 can be moved between an open position of the dispensing aperture 16 and a closed position of the dispensing aperture 16. FIGS. 3, 4 and 8 show an open position while FIGS. 5, 6 and 7 show a closed position.

In the open position, the cathode 31 of the visual means 30 establishes an electrical connection by means of the electrically conductive element 8 to the positive terminal of the battery 41. As for the anode 32, this establishes an electrical connection to the negative terminal of the battery 40. In this case, the visual means are supplied with electricity and therefore light up.

In the open position, the user can remove cosmetic and/or care products contained in the container 1 and apply it using the product application means 7. The illumination of the diodes makes it possible to illuminate the desired skin surface such as the face and in particular the lips, eyelids, cheeks, eyelashes or else the nails. The mirror 18 disposed on the container 1 also facilitates the application of the product.

Once the product has been applied, the user closes off the dispensing aperture by replacing the cap 2 on the neck 12 of the container. During this closing, the free end 500 of the legs 50 comes to rest against the shoulder 13 of the neck of the container. This resting brings about a sliding of the switch in relation to the holder 6. Such sliding then provides a translational movement of the switch 5 having the effect of moving the battery 40 away from the anode 32 and thus breaking the electrical contact between the visual means 30 and the power supply 4. This breaking of contact then results in extinguishing of the visual means.

Consequently, in this embodiment, the shoulder 13 of the container constitutes an actuator or means of actuating the switch capable of moving it in order to make the visual means change state, and more precisely capable of making the visual means change from a lit illuminating state to an unlit or non-illuminating state.

In the closed position of the container, the free edge 15 of the container and the actuator or actuation means 13 extend according to two distinct respective axial heights, and the actuation means are axially offset in relation to said dispensing aperture. Thus two distinct parts of the device can be specifically devoted on the one hand to sealing the device and on the other hand to selective activation of the visual means. In this closed position, the switch can be inaccessible. Similarly, the visual means can be inaccessible.

The movement of the cap into the open position again establishes the electrical connection between the battery 40 and the anode 32 of the visual means. In other words, the power supply 4 can again supply the sensory stimulation member 3 with electricity. The visual means 30 are then again illuminated. The elastic means 81 facilitate this bringing of the battery 40 into contact with the anode 32 of the visual means during removal of the cap 2.

Such a device therefore allows on the one hand the user to clearly discern the body surface to be coated with product. On the other hand, the fact that the sensory stimulation member is activated in the open position of the dispensing aperture makes it possible to indicate clearly to the user whether the cap has been correctly closed again after removal of product. Furthermore, the fact that the actuation means, acting on the switch, are axially and laterally offset in relation to the dispensing aperture makes it possible to improve the closing of the cap and thus the sealing of the device.

Figure 10:
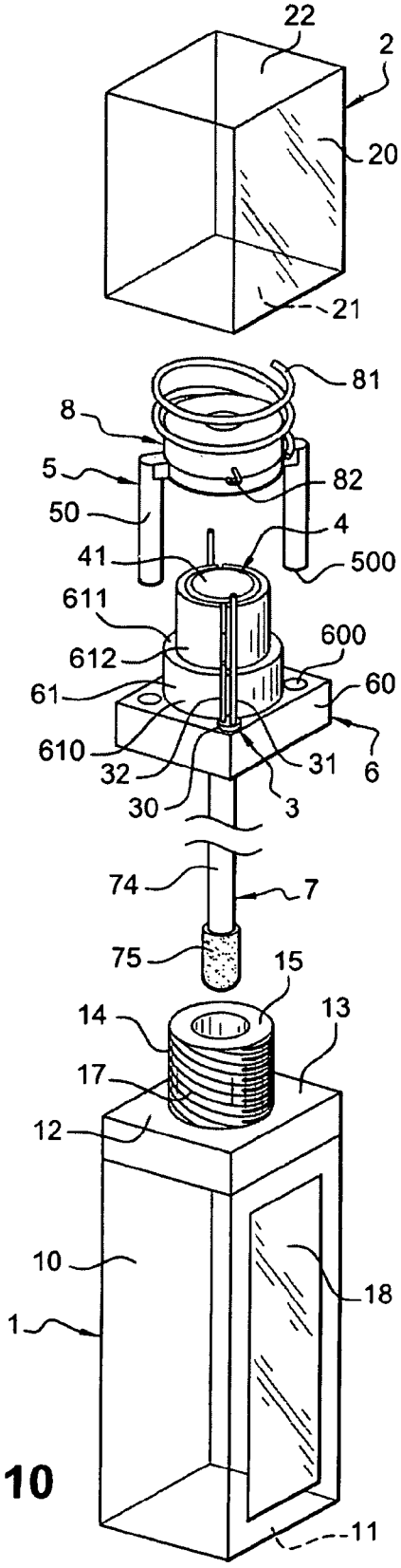
FIG. 10 is a schematic exploded perspective view of the device depicted in FIG. 9.

According to another example embodiment of the device depicted in FIGS. 9 and 10, the holder 6 can itself serve as a housing for the power supply 4.

In this case, the surface 611 of the platform of the holder can be provided with a barrel 612 with a cross-section that is smaller in size in relation to the skirt 610. Such a barrel can then be configured to accommodate the power supply. The bore provided for housing the anode 32 of the visual means can be made over the height of this barrel in order to allow positioning of the anodes prior to positioning of the batteries.

In this embodiment, the cross-member 51 of the switch 5 serves only as a support for the electrically conductive element 8. Thus, only the element 8 is fixed movement-wise to the switch 5 in such a case.

According to another variant embodiment of the device, the skirt 610 of the platform of the holder could rise directly above the surface 611 so as to internally define a housing for the power supply 4.

In such embodiments, when the cap changes from a position of opening of the dispensing aperture 16 to a position of closing of this aperture, the free end 500 of the legs 50 of the switch induces the movement of the electrically conductive element 8 by moving away from the power supply. The cathode 31 of the visual means is then no longer in electrical contact with the positive terminal of the battery 41. This interruption of electrical contact then brings about extinguishing of the visual means. In such an embodiment, the power supply remains immobile in the cap. The anodes 32 of the visual means can then remain permanently in contact with the battery 40.

Figure 13:
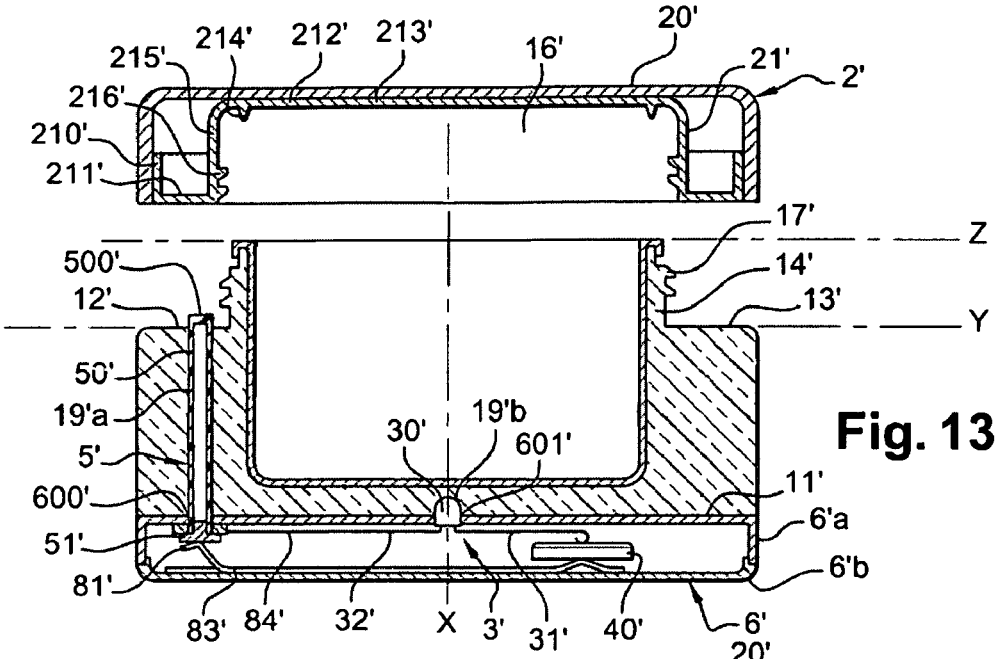
FIG. 13 is a schematic view in longitudinal section of a second embodiment of the present invention in a first position.
Figure 14:
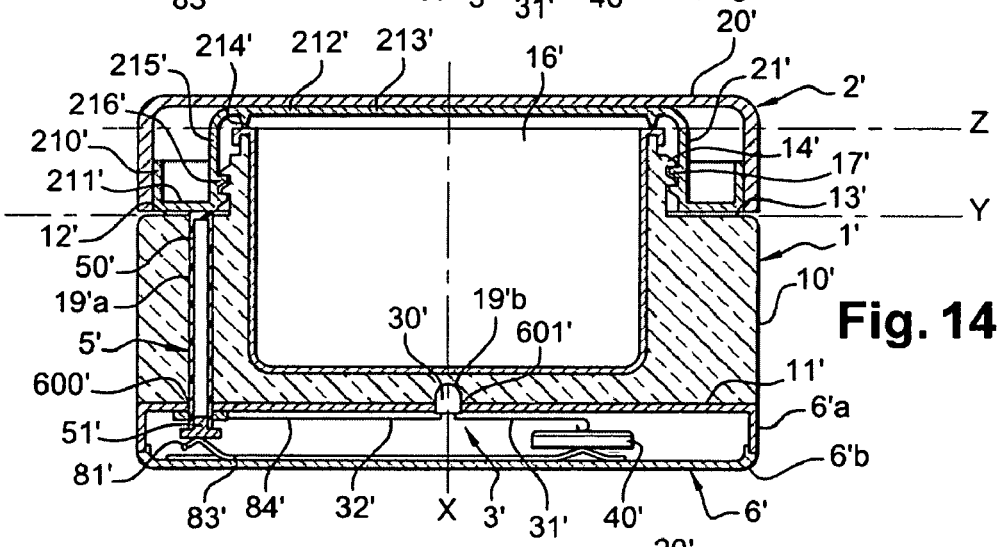
FIG. 14 is a schematic view in longitudinal section of the device depicted in FIG. 13 in a second position.
Figure 15:
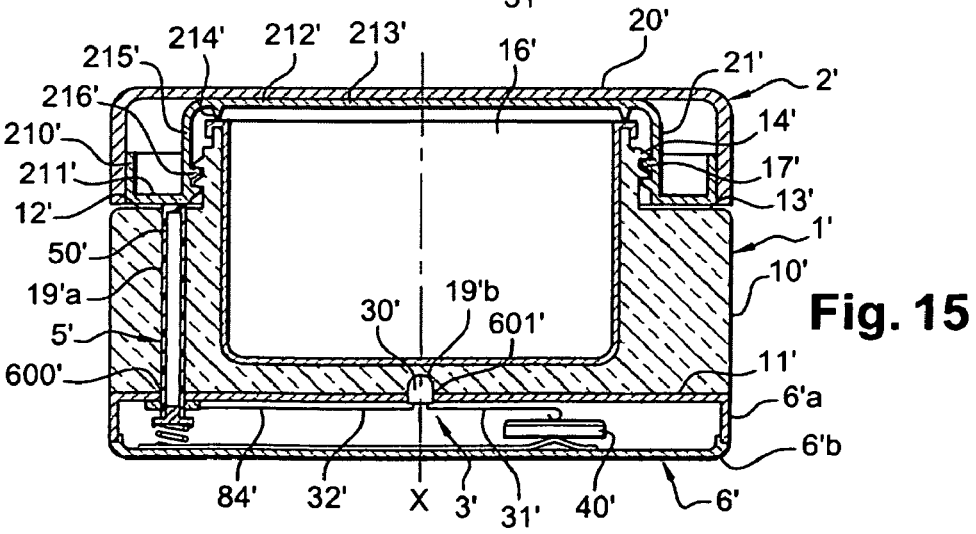
FIG. 15 is a schematic view in longitudinal section of a variant embodiment of the device according to the invention.

FIGS. 13 to 15 depict another example of an embodiment of a device according to the invention. Similar numerical references with a prime sign added have been assigned to parts similar to the device described previously.

In this example, the device comprises an illumination module fixed to the container 1'.

The container 1' can be a jar for packaging a cosmetic and/or a care product, with a capacity for example of 20 to 200 ml of fluid product. Such a container can have a width greater than that of the container 1 and a height less than that of the container 1'. By way of example, this width can lie between 50 mm and 120 mm, and in particular between 65 and 80 mm, and this height can lie between 20 mm and 60 mm, and in particular between 25 and 40 mm.

By way of example, the shoulder 13' and the free edge 15' of the container 1' can be spaced apart from each other by a height lying between 5 and 15 mm, and in particular between 8 and 12 mm.

The container 1' can be made from a transparent or translucent material. Such a container can thus for example be made from a plastic material or glass.

The container 1' can also internally house a dish 9', for example made from a metallic material, as a cosmetic and/or care product reservoir.

The container 1' can include a duct 19'*a* extending from the bottom wall 11' of the container 1' to the shoulder 13' of the neck of the container. Such a duct can thus extend through the side wall 10' of the container. It can extend parallel to the elongation axis X of the container 1'. In a variant this duct could extend intersecting this elongation axis X of the container. Such a duct can have any suitable shape of cross-section such as circular, elliptical, oval, polygonal or some other. The function of such a duct will be mentioned later in this description.

The container 1' can also comprise a housing 19'*b*. This housing can include a recess made in the bottom wall 11'. Such a recess can thus be situated under the fluid product reservoir and in particular under the dish 9'. This recess can for example have a dome or cupola shape.

The dispensing aperture 16' of this container can be selectively closed off by a cap 2'. This cap can include an overcapsule 20' in which an insert 21' is mounted.

The overcapsule 20' can for example be made from a metallic material.

The insert 21' can for example be made from a plastic material. This insert can include a peripheral skirt 210' connected by a radial collar 211' to a member 212' for closing off the dispensing aperture 16'. This radial collar can for example have an overall annular shape.

The peripheral skirt 210' can be mounted clamped in the overcapsule 20'. This peripheral skirt can be mounted by press-fitting, screwing or latching in this overcapsule.

The closing-off member 212' can include a plate 213' provided with a seal or sealing means 214'. Such sealing means can include a lip or a seal. The sealing means can possibly be added onto the plate 213'. To do this, they can be overmoulded or bonded onto this plate, for example. They can be made from an elastomeric material. This plate can for example be disc-shaped.

The closing-off member 212' can also include a sleeve 215' provided internally with an attaching arrangement or fixing arrangement, or fixing means 216'. This sleeve 215' is connected to the radial collar 211'.

In the position of closing of the cap 2' on the mouthpiece 14' of the neck of the container, the fixing means 215' can cooperate with the fixing means 17' of the mouthpiece. The plate 213' can then take up a position opposite the dispensing aperture 216. The sealing means 214' can then come to rest in a sealed manner on the free edge 15' of the container 1' in order to seal the dispensing aperture 16'. As for the radial collar 211', this forms a free end of the cap capable of taking up a position opposite the shoulder 13'. More precisely, this radial collar can come to rest on this shoulder. As for the overcapsule 20', this can extend in line with the side wall 10' of the container 1.

According to another example of an embodiment, the cap 2' could be made in a single piece. In such a case this cap could include in a similar manner a plate connected to a collar by a crank so that the cap can cooperate with parts of the container extending to two distinct axial heights in relation to the elongation axis X of the container. Such a crank can be continuous so that this plate and this collar extend according to two different planes.

The illumination module comprises a holder 6'. This holder can be made from an opaque material in order to mask the contents thereof. In particular it can be made from a plastic or metallic material. When this holder is made from a metallic material, it can be coated internally with an insulating material such as a varnish or a lacquer.

The holder 6' can be made in two parts 6'*a*, 6'*b* which can be connected in a fixed manner to each other by any suitable means, for example press fitting, latching or screwing.

This holder houses in this example a visual means 30', a battery 40' and a switch 5'. The sensory stimulation member, in this case the visual means 30', is fixed in relation to the container, and in particular in relation to the holder. Such a sensory stimulation member is thus incapable of being moved rotationally or translationally in relation to the structure housing it.

The switch 5' includes in this example a leg 50' having a foot 51'. Such a foot can extend transversely in relation to an axis in which the rod 50' extends.

The part 6'*a* of the holder 6' can include an opening 600' dedicated to passage of the leg 50' of the switch 5' and an opening 601' dedicated to passage of the visual means 30'. The switch and the visual means, in this case a light emitting diode, can thus extend on either side of their respective opening 600', 601'.

This switch 5' can be mounted on a spring or elastic means 81'. These elastic means can include, for example, a flexible strip as depicted in FIGS. 13 and 14 or a coil spring as depicted in FIG. 15.

The elastic means 81' can be connected to a support plate 83' fixed to the part 6'*b* of the holder. By way of example, the elastic means can be made in a single piece with this plate. Such a plate can also support the battery 40', and in particular the negative terminal of this battery. The positive terminal of this battery can be connected electrically to the cathode 31' of the visual means.

As for the anode 32' of the visual means, this can be connected to a conductive plate 84' fixed to the part 6'*a* of the holder. To do this, the anode can be, for example, thermally bonded onto this plate.

The foot 51' of the switch can establish a selective electrical contact with the conductive plate 84'.

The part 6'*a* of the holder can be associated reversibly or permanently by any suitable means with the container 1' such as by screwing, latching, gluing or welding. For example, this part 6'*a* can be associated with the bottom wall 11' of the container. In this case, the bottom of the device is formed by the part 6'*b* of the holder which will be intended to come into contact with a resting surface.

The duct 19'*a* can then accommodate the leg 50' of the switch. The switch 5' and the duct can have an identical shape in cross-section in order to guide the movement of the switch 5' inside the duct 19'*a*.

As for the housing 19'*b*, this can accommodate the visual means 30'.

The operation of this embodiment of the device according to the invention will now be described with reference to FIGS. 13 and 14.

The cap 2' can be moved between a position of opening of the dispensing aperture 16' and a position of closing of the dispensing aperture 16'. FIG. 13 shows such an open position while FIG. 14 shows the closed position.

In the open position, the foot 51' comes to rest under the plate 84' so as to electrically connect the visual means 30' and the battery 40' and thus allow its illumination. The light emitted by the visual means 30' can then diffuse through the container 1'.

Once the product has been removed, the user closes off the dispensing aperture 16' by replacing the cap 2' on the mouthpiece 14' of the neck of the container. During this closing, the radial collar 211' of the insert of the cap 2' comes to rest on the switch 5'. This resting then moves the switch in relation to the duct 19'*a* by sliding. Such a movement then moves the foot 51' of this switch away from the conductive plate 84'. The visual means 30' is then no longer supplied with power and goes out. At the end of travel of the cap, the radial collar can possibly come to rest on the shoulder 13' of the neck of the container.

In such an embodiment, the radial collar 211' therefore forms actuation means capable of acting on the switch 5' in order to make the sensory stimulation member change state.

Furthermore, in the position of closing of the container 1', the sealing means 214' can come to rest on the free edge 15' of the container in order to provide the sealing thereof.

During the movement of the cap into the open position, the elastic means again induce the foot 51' of the switch into contact, thus again allowing an electrical supply for the visual means and its illumination.

It should be noted that the electrical connections described in the different embodiments are given only by way of illustration and example, other connections or configurations can be used.

Throughout the description, expressions "comprising a," "including," "having" or "has" are to be considered as being synonymous with "comprising at least one," unless the contrary is specified. Similarly, expressions such as "comprising two" (or higher numbers) are to be construed as including "at least" the number identified unless otherwise specified.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A device for dispensing a cosmetic and/or care product comprising:

a container that is configured to contain the product, the container including a free edge defining a product dispensing aperture, said container having an axis intersecting the dispensing aperture;

a cap that is configured to be mounted on the container and that is movable between a closed position, which closes the aperture, and an open position, which allows access to said aperture;

a sensory stimulation member fixed in relation to one of the container or the cap housing it;

a power supply for the sensory stimulation member;

a switch, which is inaccessible in the closed position, and which causes the sensory stimulation member to change state;

switch actuation means which selectively connects said power supply to said sensory stimulation member in response to movement of the cap from the closed position, wherein, in the closed position of the cap, said free edge and said actuation means are disposed at distinct respective axial heights, such that the free edge is axially closer to the power supply than is the actuation means, and wherein said actuation means is axially offset from said dispensing aperture.

2. The device according to claim 1, wherein said switch comprises a support surface which contacts an actuation surface of the actuation means in said closed position, and wherein said support surface and said actuation surface are disposed at a distinct respective axial height in relation to said free edge and are axially offset from said dispensing aperture.

3. The device according to claim 1, wherein movement of the cap from the closed position to the open position automatically connects said power supply to said sensory stimulation member.

4. The device according to claim 1, further comprising sealing means which seal the dispensing aperture.

5. The device according to claim 1, wherein the actuation means and the free edge extend radially in two distinct planes, which are parallel to each other.

6. The device according to claim 1, wherein the actuation means and the free edge extend radially in two distinct planes, which are substantially perpendicular to the axis of the container.

7. The device according to claim 1, wherein the container comprises a neck.

8. The device according to claim 7, wherein said neck comprises a shoulder from which a mouthpiece rises, wherein said free edge is provided in said mouthpiece, and wherein the switch extends to a level of said shoulder, which shoulder is the actuation means.

9. The device according to claim 8, wherein said mouthpiece comprises reversible fixing means for mounting the cap.

10. The device according to claim 9, wherein the reversible fixing means includes a threaded mounting arrangement.

11. The device according to claim 1, further comprising a holder mounted in a fixed manner in the cap, said holder including a passage through which said switch extends.

12. The device according to claim 1, wherein said switch comprises at least one leg which is slidably movable relative to the cap and/or the container.

13. The device according to claim 1, further including an elastic device which biases said switch.

14. The device according to claim 1, wherein said sensory stimulation member comprises illumination means and in particular at least one light emitting diode.

15. The device according to claim 1, further comprising product application means.

16. The device according to claim 1, wherein the switch includes two legs that are radially spaced from a longitudinal axis of the device, such that, in the closed position, the two legs extend longitudinally toward the actuation means.

17. The device according to claim 16, wherein the container includes a neck, and wherein the two legs are substantially parallel and are disposed radially offset from the neck.

* * * * *